US008154507B2

(12) United States Patent
Shimoji

(10) Patent No.: US 8,154,507 B2
(45) Date of Patent: Apr. 10, 2012

(54) BACK LIGHT SYSTEM AND LIQUID CRYSTAL DISPLAY DEVICE USING THE BACK LIGHT SYSTEM

(75) Inventor: Noriyuki Shimoji, Kyoto (JP)

(73) Assignee: Rohm Co., Ltd., Kyoto-shi (JP)

( * ) Notice: Subject to any disclaimer, the term of this patent is extended or adjusted under 35 U.S.C. 154(b) by 621 days.

(21) Appl. No.: 12/321,547

(22) Filed: Jan. 22, 2009

(65) Prior Publication Data

US 2009/0189844 A1 Jul. 30, 2009

(30) Foreign Application Priority Data

Jan. 24, 2008 (JP) ..... 2008-013946

(51) Int. Cl.
*G09G 3/36* (2006.01)

(52) U.S. Cl. ..... 345/102; 345/89; 345/90; 345/84

(58) Field of Classification Search ..... None
See application file for complete search history.

(56) References Cited

U.S. PATENT DOCUMENTS 7,652,655 B2 * 1/2010 Kim ..... 345/102
7,719,512 B2 * 5/2010 Kwon ..... 345/102
7,755,594 B2 * 7/2010 Yoshihara et al. ..... 345/102

FOREIGN PATENT DOCUMENTS

JP 10-282470 10/1998

* cited by examiner

*Primary Examiner* — Muhammad N Edun
(74) *Attorney, Agent, or Firm* — Hamre, Schumann, Mueller & Larson, P.C.

(57) ABSTRACT

A back light system and a liquid crystal display device, which can reduce the power consumption substantially, are provided. The power consumption can be substantially reduced by providing a plurality of light-emitting dividing parts to which area division of the light emitting surface which illuminates with light towards a liquid crystal panel is performed, and controlling the luminescent brightness in the light-emitting dividing parts according to the corresponding display image of a display area in the liquid crystal panel.

11 Claims, 4 Drawing Sheets

BACK LIGHT SYSTEM AND LIQUID CRYSTAL DISPLAY DEVICE USING THE BACK LIGHT SYSTEM

CROSS REFERENCE TO RELATED APPLICATION AND INCORPORATION BY REFERENCE

This application is based upon and claims the benefit of priority from prior Japanese Patent Applications No. P2008-13946 filed on Jan. 24, 2008, the entire contents of which are incorporated herein by reference.

BACKGROUND OF THE INVENTION

1. Field of the Invention

The present invention relates to a back light system and a liquid crystal display device using the back light system.

2. Description of the Related Art

As a liquid crystal display device, a liquid crystal display device placing a back light system as a light source behind a liquid crystal cell is known. As the back light system, a light emitting diode, an organic electroluminescence light emitting device, etc. other than a back light system using a discharge type lamp such as a cold cathode fluorescent tube are known. The large amount of power consumption of the liquid crystal display device is attributed to the power consumption of the back light system. Either in the case where the back light system is composed using a discharge type lamp, a light emitting diode, or an organic electroluminescence light emitting device is the same as this. In particular, in the liquid crystal display device used for a mobile phone terminal, since the capacity of a battery storage for a power supply is very small, the power consumption of a back light system influences the driving period for the liquid crystal display device greatly.

As a measure for reducing the power consumption for the back light system, using a highly efficient light emitting diode, or devising the optical system of a light guide plate etc. and extracting light efficiently with little electric power is achieved. As other measures, the technology, which modulates the light of the back light system according to the surrounding luminosity, and prevents use of maximum luminance in a dark environment is known (for example, refer to Patent Document 1).

However, even when using the technology mentioned above, since the power consumption of the back light system is large, a further reduction of the power consumption for the back light system is desired. Moreover, when the luminance of the back light system is merely reduced low, there is a problem that contrast becomes small in the liquid crystal display, and then display quality deteriorates.

Patent Document 1: Japanese Patent Application Laying-Open Publication No. H10-282470

SUMMARY OF THE INVENTION

According to an aspect of the invention, a back light system comprises a plurality of light-emitting dividing parts which opposes to a display area of a liquid crystal panel and is placed behind a light transmission type liquid crystal panel, and to which area division of a light emitting surface which illuminates with light towards the liquid crystal panel is performed, wherein a luminescent brightness in the light-emitting dividing part is controlled according to corresponding display image of the display area in the liquid crystal panel.

According to another aspect of the invention, a liquid crystal display device comprises a back light system including a plurality of light-emitting dividing parts which opposes to a display area of a liquid crystal panel and is placed behind a light transmission type liquid crystal panel, and to which area division of a light emitting surface which illuminates with light towards the liquid crystal panel is performed, a luminescent brightness in the light-emitting dividing part being controlled according to corresponding display image of the display area in the liquid crystal panel; a synchronous circuit for generating a driving signal synchronizing with a scanning line of the liquid crystal panel and the light-emitting dividing part in the corresponding back light system; and a lighting control part whose light is modulated so that a light-emitting of luminescence which achieves luminance of a pixel which act as maximum luminance among pixel rows taken along the scanning line is performed from the light-emitting dividing part.

According to the present invention, the back light system which can reduce power consumption, and the liquid crystal display device which can reduce the power consumption and is excellent in display quality can be provided.

According to the present invention, the back light system and the liquid crystal display device, which can reduce the power consumption substantially, can be achieved.

Moreover, according to the present invention, the liquid crystal display device, which can reserve the large contrast of the liquid crystal display, can be achieved.

DETAILED DESCRIPTION OF THE EMBODIMENTS

Figure 1:
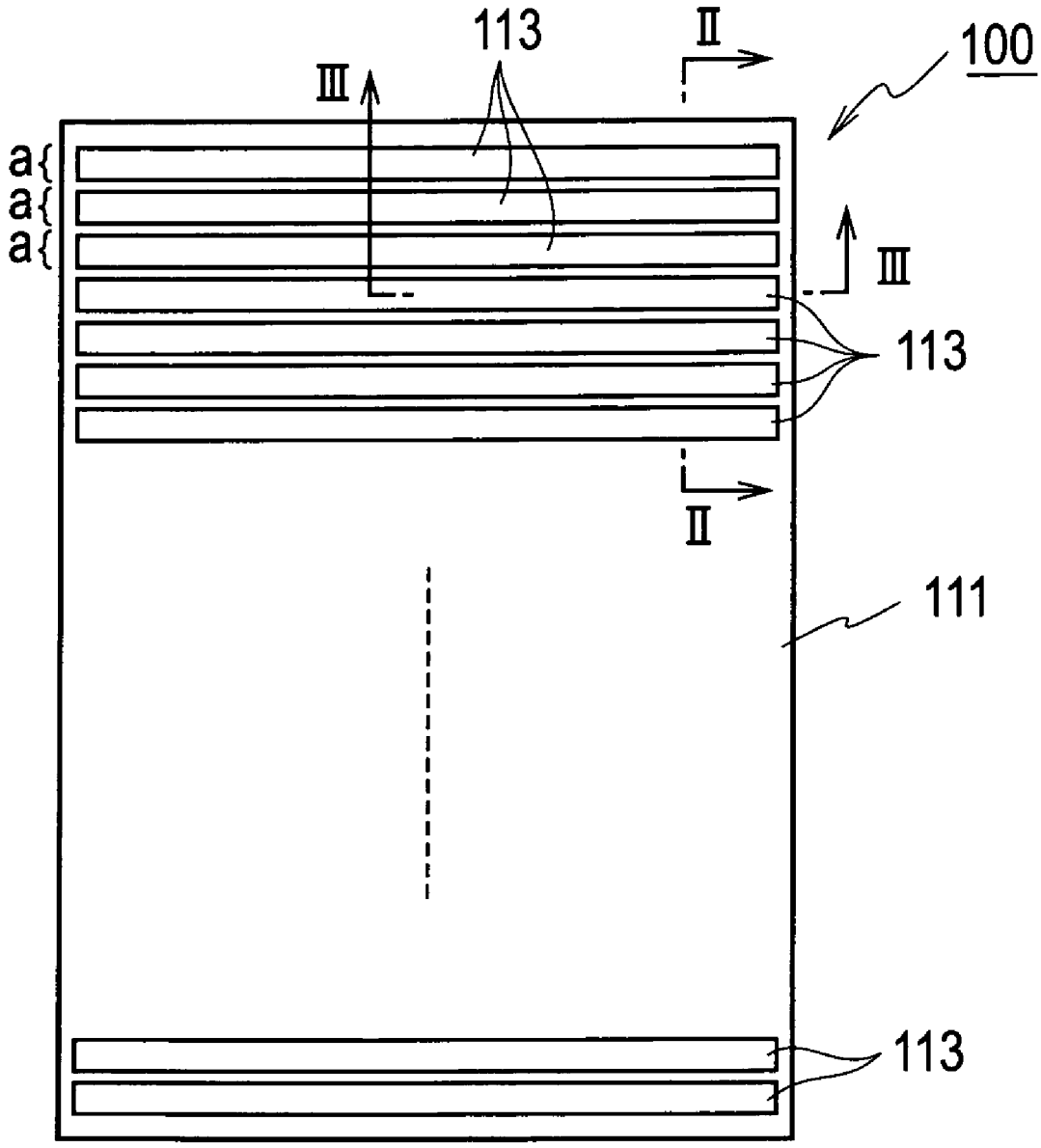
FIG. 1 is a top view showing a back light system according to an embodiment of the present invention.

Various embodiments of the present invention will be described with reference to the accompanying drawings. It is to be noted that the same or similar reference numerals are applied to the same or similar parts and elements throughout the drawings, and the description of the same or similar parts and elements will be omitted or simplified.

The embodiments shown below exemplify a system and an apparatus that are used to implement the technical ideas according to the present invention, and do not limit the technical ideas according to the present invention to those that appear below. These technical ideas, according to the present invention, may receive a variety of modifications that fall within the claims.

First Embodiment

Figure 4:
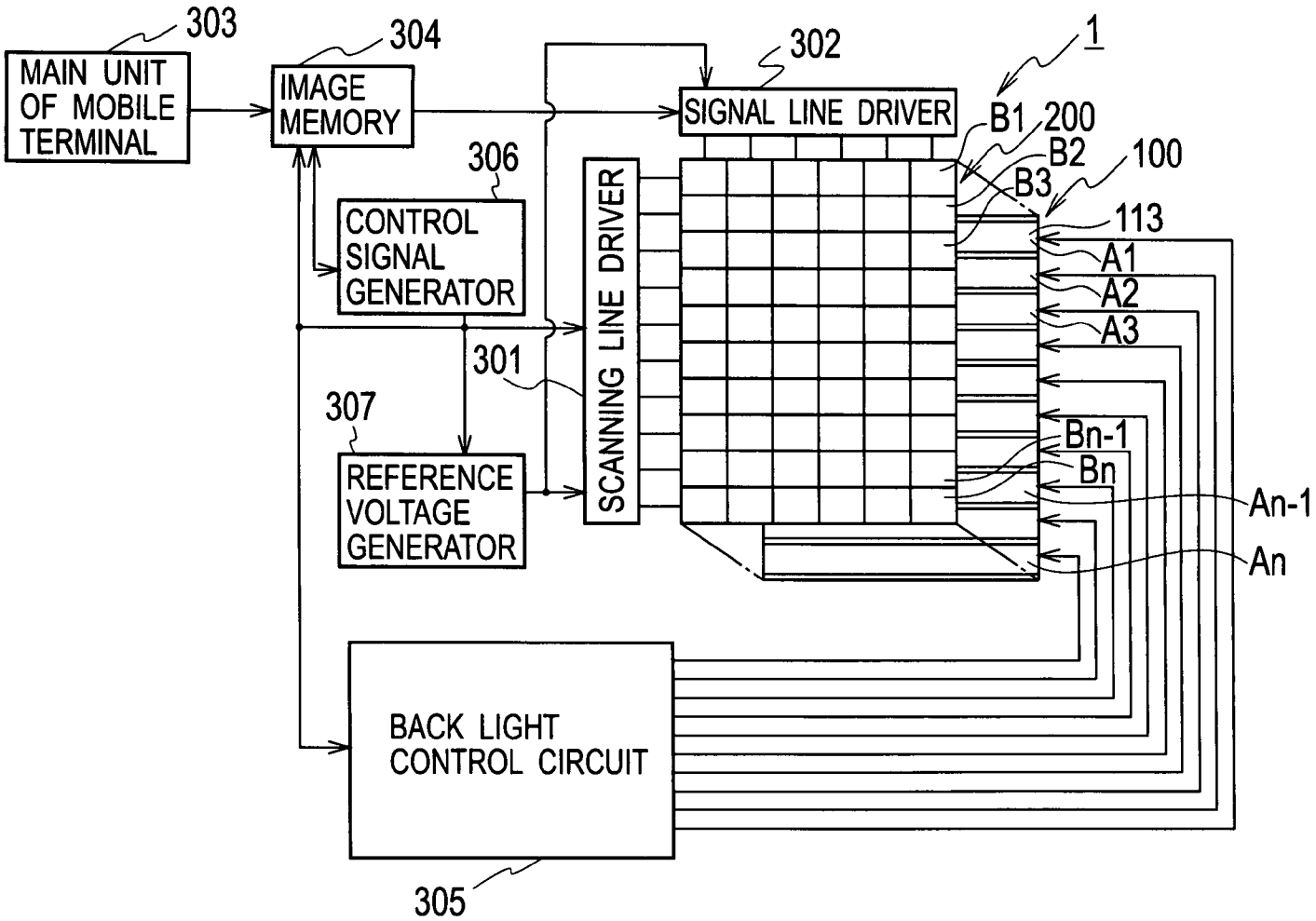
FIG. 4 is a configuration diagram showing a liquid crystal display device using the back light system according to an embodiment of the invention.
Figure 5:
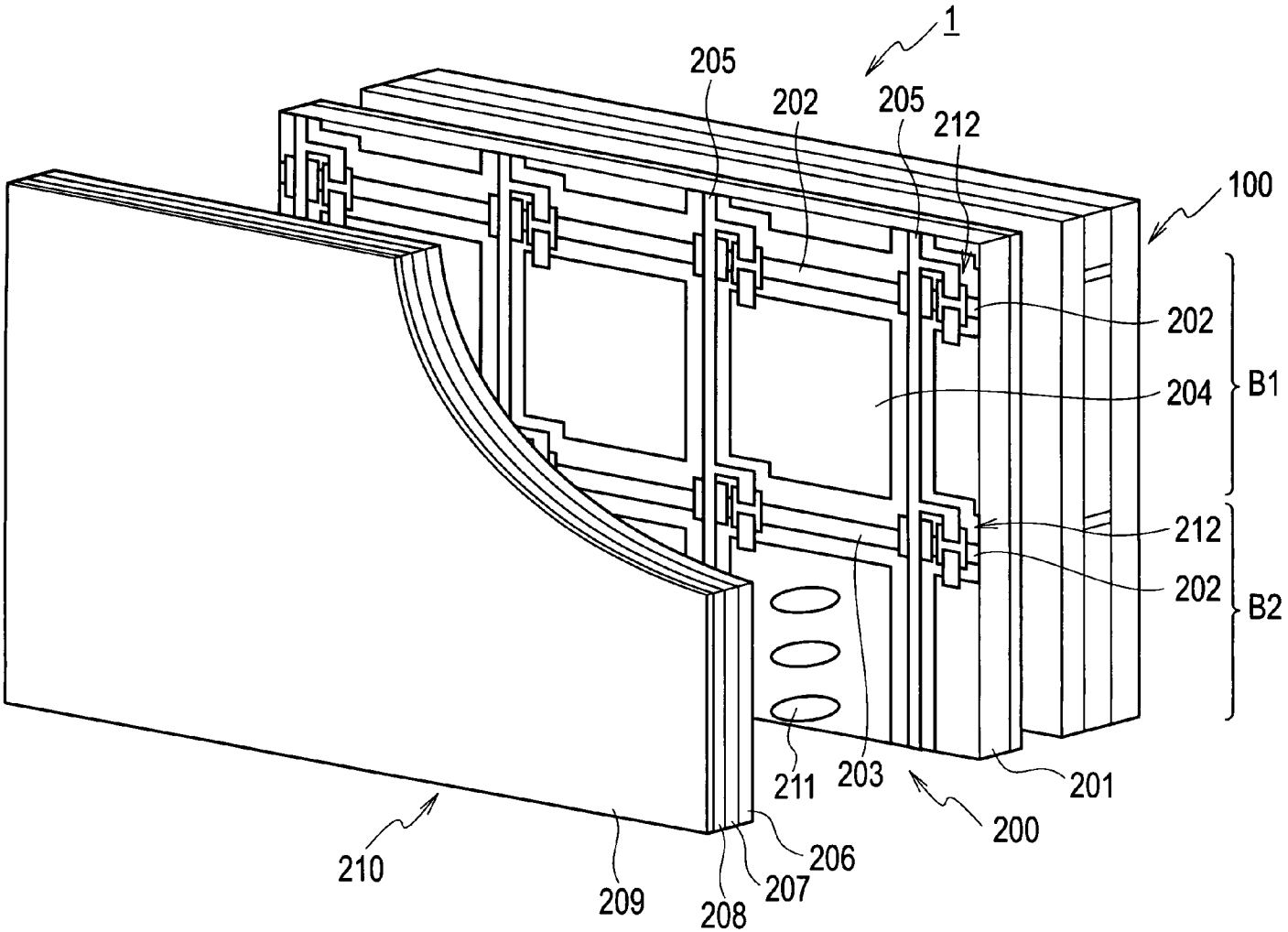
FIG. 5 is an important section perspective diagram showing the liquid crystal display device according to an embodiment of the present invention.

Hereinafter, details of a back light system and a liquid crystal display device according to the present invention will be explained based on drawings. FIG. 1 is a top view showing the state where a transparent substrate by the side of a light emitting surface of a back light system according to the present invention is removed, FIG. 2 is a sectional view showing the back light system taken in the line II-II of FIG. 1, FIG. 3 is a sectional view showing the back light system taken in the line III-III line of FIG. 1, FIG. 4 is a configuration diagram showing a liquid crystal display device, and FIG. 5 is a perspective diagram of the liquid crystal display device.

(Back Light System)

Figure 2:
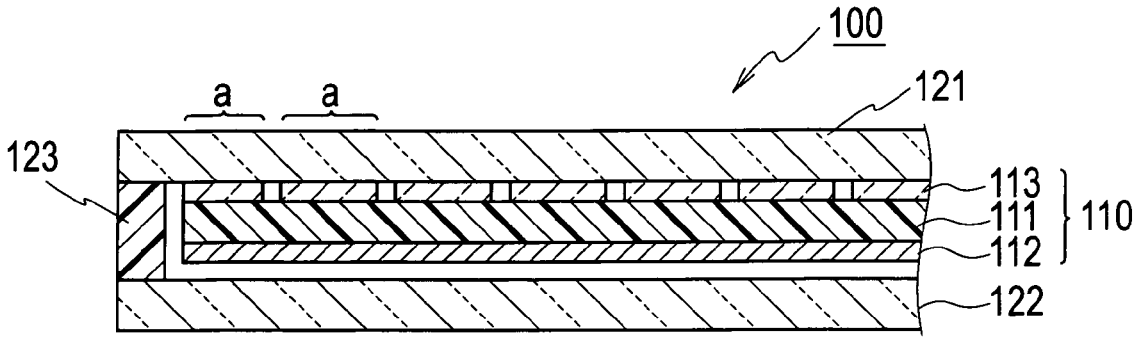
FIG. 2 is a sectional view taken in the line II-II of FIG. 1.
Figure 3:
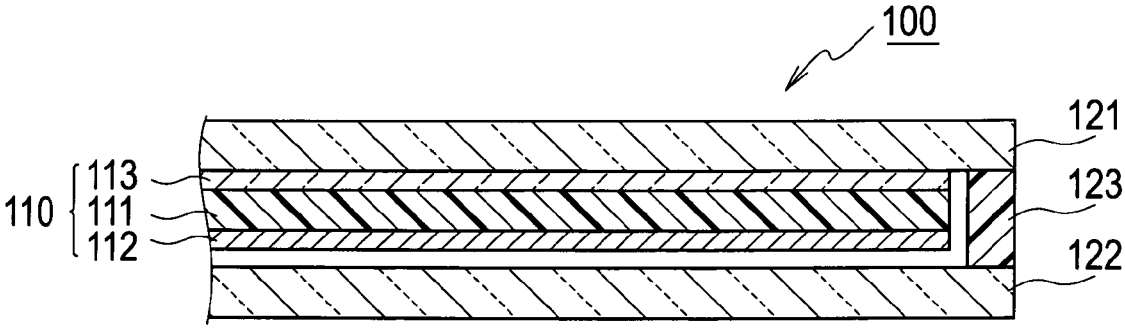
FIG. 3 is a sectional view taken in the line III-III of FIG. 1.

As shown in FIG. 2 and FIG. 3, a back light system 100 according to this embodiment is the structure, which seals an organic electroluminescent light emitting device 110.

As shown in FIG. 2 and FIG. 3, the organic electroluminescent light emitting device 110 is composed so that an organic layer 111 is pinched by the one cathode electrode 112 and a plurality of anode electrodes 113.

The organic layer 111 has the same shape and the almost same size as a display area of a liquid crystal panel, which is not illustrated, for which this back light system 100 is used. Moreover, the organic layer 111 is composed so that an electron transport layer, a luminous layer, and a hole transporting layer, which are not illustrated, are laminated one after another to the anode electrode 113 side from the cathode electrode 112 side. The cathode electrode 112 is formed so that the whole of the surface by the side of the electron transport layer, which is not illustrated of the organic layer 111 as a common electrode, may be covered mostly.

The anode electrodes 113 are composed of a transparent conductive material. Moreover, the anode electrodes 113 are formed so as to correspond to the pixel row taken along a scanning line of the liquid crystal panel in which this back light system 100 is used, respectively. Therefore, a plurality of anode electrodes 113 are placed in the same pitch at stripe shape at the pixel row taken along the scanning line of the above-mentioned liquid crystal panel.

Here, as a transparent conductive material, which composes the anode electrodes 113, a metal, an alloy, an electrical conductivity compound of a large work function, or the electrode material composed combining these can be used. More specifically, there are conductive transparent materials, such as metal, such as gold (Au), CuI, ITO, $SnO_2$, ZnO, and IZO.

On the other hand, as a conductive material, which composes the cathode electrode 112, a metal, an alloy, an electrical conductivity compound of a small work function, and the electrode material composed combining these can be used. More specifically, aluminum (Al), lithium (Li), magnesium (Mg), sodium, a sodium potassium alloy, a magnesium silver compound, a magnesium indium compound, an aluminum-lithium alloy, an $Al/Al_2O_3$ compound, an Al/LiF compound material, etc. can be used. This cathode electrode 112 can be formed by these electrode materials in a thin film using a vacuum evaporation method, a spattering process, etc.

As a luminous layer which is not illustrated among the organic layers 111, the material as a well-known luminous layer of pyrene, anthracene, naphthalene, tetracene, coronene, a perylene, a phtalo perylene, a naphthalo perylene, diphenyl butadiene, tetraphenyl butadiene etc. and various kinds of materials doped to these can be used, for example.

As a hole transport Layer, the well-known polymeric materials, such as a phthalocyanine derivative, a naphthalocyanine derivative, a porphyrin derivative, N,N'-bis(3-methylphenyl)-(1,1'-biphenyl)-4,4'-diamine (TPD), etc. can be used, for example.

As an electron transport layer, diphenoquinone, an imidazole, a fluorene, a bathophenanthroline, anthra quinodimethanes, etc. those compounds, a metal complex compound, or a nitrogen-containing five-membered ring derivative can be used, for example.

As shown in FIG. 2 and FIG. 3, the organic electroluminescent light emitting device 110 of the above-mentioned configuration is sealed between glass substrates 121,122 as a transparent substrate of a pair which opposes mutually. More specifically, another glass substrate 122 opposes and is placed, and it has structure which sealed between the edge parts of the glass substrates 121,122 comrades by a sealant 123 so that the anode electrode 113, the organic layer 111, and the cathode electrode 112 by which pattern formation is performed may be formed in the back side of the glass substrate 121 by the side of optical emission one after another and the back side of the cathode electrode 112 may be opposed. In addition, in order to control degradation of the organic layer 111, a vacuum or inert gas is sealed in the space surrounded by the glass substrates 121,122 and the sealant 123.

According to such a configuration, the region with which the cathode electrode 112 and the anode electrode 113 overlap becomes light-emitting dividing parts A1 to An of the stripe shape which is a luminous unit of the organic electroluminescent light emitting device 110. These lights outgoing radiation dividing parts A1 to An are dividing the light emitting surface of the back light system 100 into plural lines mostly. For this reason, the arbitrary light-emitting dividing part A can be made to emit light by applying positive voltage to the anode electrode 113 selectively, in the condition that negative voltage is applied to the cathode electrode 112 which is a common electrode. Moreover, it is possible to modulate the light of the luminescent brightness of the light-emitting dividing part A by changing the voltage applied to the anode electrode 113.

When combining with a liquid crystal panel, the light of the back light system 100 of this embodiment can be modulated to every light-emitting dividing part a corresponding to each pixel row taken along the scanning line of the liquid crystal panel. It is not necessary to emit light uniformly in the whole light emitting surface in the light emitting power corresponding to the maximum display luminance in the whole of one frame of liquid crystal display in the back light system 100 whole by controlling luminescence of light emitting power corresponding to the maximum display luminance in the pixel row taken along the scanning line of the liquid crystal panel. For this reason, according to the back light system 100 according to this embodiment, the power consumption can be controlled substantially.

In the conventional liquid crystal display, the light of the excessive luminosity is emitted from the back light system also by the image region set as the dark display. According to the back light system 100 according to this embodiment, intensity control can be performed for every pixel row taken along each scanning line. Therefore, since the back light system 100 can be driven so that it may become dark luminescence in the image region set as the dark display and may become bright luminescence in the image region set as the bright display, the large contrast of liquid crystal display can be reserved.

(Liquid Crystal Display Device)

As shown in FIG. 4 and FIG. 5, the liquid crystal display device 1 related to this embodiment is composed of the back light system 100 mentioned above and a light transmission type liquid crystal panel 200.

According to this embodiment, although an active matrix type liquid crystal display element is used as the liquid crystal panel 200, a liquid crystal display element of a passive matrix type may be used.

As shown in FIG. 5, the liquid crystal panel 200 seals a liquid crystal 211 between a pair of a back glass substrate 201 and a front glass substrate 207 which oppose mutually.

A scanning line (gate line) 202 and a signal line (data line) 205 which are formed so as to being intersected keeping an electrical insulation state mutual are formed on the front of the back glass substrate 201. In the picture element region of the rectangular shape divided by matrix form with these scanning line 202 and signal line 205, a picture element electrode 204 of rectangular shape is formed. Moreover, a TFT (Thin Film Transistor) 212 as a switching element is provided on the part, which these scanning lines 202 and signal line 205 intersect. Moreover, the orienting film, which is not illustrated, is provided on the front side of the back glass substrate 201 of such a configuration. Furthermore, a polarizing plate 213 is provided on the rear surface of the back glass substrate 201.

A transparent common electrode 206 is provided on the rear surface of the front glass substrate 207, covering all over almost. An orienting film, which is not illustrated, is provided on the rear surface of this common electrode 206. Moreover, according to the setup of R, G, B of each pixel, a color filter layer 208 is provided on the front of the front glass substrate 207. Furthermore, a polarizing plate 209 is provided on the front side of the color filter layer 208.

The back light system 100 mentioned above is placed so as to oppose behind such the liquid crystal panel 200. The back light system 100 is placed so that each of the light-emitting dividing parts A1 to An placed at stripe shape may oppose with the rows B1 to Bn of the picture element electrode 204 taken along the scanning line 203 of the liquid crystal panel 200. That is, it is set up so that the pitch of the rows B1 to Bn of the picture element electrode 204 of the liquid crystal panel 200 and the pitch of the light-emitting dividing parts A1 to An of the back light system 100 may become the same.

A scanning line driver 301 and a signal line driver 302 are connected to the liquid crystal panel 200. The picture element electrode 204 is driven by controlling ON and OFF by the thin film transistor 212, and turning ON and OFF of the scanning line 203 by the scanning line driver 301 and turning ON and OFF of the signal line 205 by the signal line driver 302 selectively. The luminous intensity from the back light system 100, which passes through each pixel in the liquid crystal panel 200, is controlled by a signal from the signal line 205.

As shown in FIG. 4, the scanning line driver 301 and the signal line driver 302 are connected to an image memory 304 for storing image data, respectively. The image memory 304 is connected to a main unit of mobile terminal 303 side, for example, and displayed data is inputted from the main unit of mobile terminal 303. The image memory 304 stores the displayed data inputted from the main unit of mobile terminal 303, and outputs the image data for every pixel synchronizing with a synchronizing signal generated from a control signal generator 306.

Moreover, as shown in FIG. 4, the synchronizing signal generated in the control signal generator 306 is outputted also to the scanning line driver 301, a reference voltage generator 307, and a back light control circuit 305.

The scanning line driver 301 controls ON and OFF of the scanning line 203 synchronizing with the synchronizing signal from the control signal generator 306.

The reference voltage generator 307 generates a reference voltage synchronizing with the synchronizing signal from the control signal generator 306, and supplies the reference voltage to the scanning line driver 301 and the signal line driver 302.

Simultaneously with selection of the scanning line 203 driven by the scanning line driver 301 synchronizing with the synchronizing signal from the control signal generator 306, the back light control circuit 305 outputs a driver voltage to the rows B1 to Bn of the picture element electrode 204 on which this scanning line 203 is located, and the corresponding light-emitting dividing parts A1 to An. At this time, in the back light control circuit 305, the driver voltage which acts as the light intensity which achieves luminance in the pixel set as the highest luminance among each row in the rows B1 to Bn of the picture element electrode 204 of the liquid crystal panel 200 is calculated from the image data from the image memory 304. Then, the driver voltage calculated for every rows B1 to Bn of each picture element electrode 204 simultaneously with the selection of the rows B1 to Bn of the picture element electrode 204 is supplied to the anode electrode 113 of the light-emitting dividing parts A1 to An. Thus, the back light control circuit 305 has a function as a lighting control unit for controlling the light emitting power in each light-emitting dividing part A.

Thus, in the liquid crystal display device 1 related to this embodiment, when the scanning line 203 of the liquid crystal panel 200 is selected by line sequential, the light emitting power is changed into every light-emitting dividing part A so as to correspond to this maximum luminance, according to the maximum luminance in the row B of the picture element electrode 204 taken along the scanning line 203. For this reason, since what is necessary is just to reduce the light emitting power of the light-emitting dividing part A corresponding to this row B when the row B of the picture element electrode 204 taken along the scanning line 203 is a dark display, the power consumption can be reduced low. Moreover, when the row B of the picture element electrode 204 taken along the scanning line 203 is a bright display, only the light-emitting dividing part A corresponding to this row B can apply light emitting power high, can avoid making light emit with light emitting power high to the region of other dark rows B, and can reduce low the power consumption of the back light system 100 per frame of liquid crystal display.

Other Embodiments

While the present invention is described in accordance with the aforementioned embodiments, it should not be understood that the description and drawings that configure part of this disclosure are to limit the present invention. This disclosure makes clear a variety of alternative embodiments, working examples, and operational techniques for those skilled in the art.

For example, in the above-mentioned embodiment, although the anode electrode 113 is formed in stripe shape so as to correspond with the row B of a pixel in the back light system 100, it is formed in stripe shape so that the cathode electrode 112 may correspond with the row B of a pixel, and it is effective also using the anode electrode 113 as the common electrode.

Moreover, although the light emitting surface is divided according to the row B of a pixel and is applied the row B of the pixel with the light-emitting dividing part A of the same number in the above-mentioned embodiment, it may be made for the one light-emitting dividing part A to correspond ranging over the row B of a plurality of pixels.

Furthermore, a prism sheet set up so that it could be emitted towards the row B of a corresponding pixel may be placed on the emission face of the back light system 100, without diffusing the light emitted from the light-emitting dividing part A.

Accordingly, the technical scope of the present invention is defined by the claims that appear appropriate from the above explanation, as well as by the spirit of the invention. Various modifications will become possible for those skilled in the art after receiving the teachings of the present disclosure without departing from the scope thereof.

INDUSTRIAL APPLICABILITY

The back light system and the liquid crystal display device using the back light system of the present invention is applicable to whole mobile terminal devices

What is claimed is:

1. A back light system comprising:

a plurality of light-emitting dividing parts which opposes a display area of a liquid crystal panel and are placed behind a light transmission type liquid crystal panel, and on which area division of a light emitting surface which illuminates with light towards the liquid crystal panel is performed, wherein a luminescent brightness in the light-emitting dividing part is controlled according to corresponding display image of the display area in the liquid crystal panel, the light-emitting dividing part is composed of an organic electroluminescence light emitting device, and a plurality of light-emitting dividing parts on which the area division of the light emitting surface is performed include a common organic electroluminescence layer, and one of an anode electrode or a cathode electrode is divided so as to correspond to the pixel row taken along a scanning line.

2. The back light system according to claim 1, wherein the light-emitting dividing part is formed so as to correspond for every pixel row taken along a scanning line of the liquid crystal panel.

3. The back light system according to claim 2, wherein the light of the light-emitting dividing part can be modulated corresponding to every pixel row taken along the scanning line of the liquid crystal panel.

4. The back light system according to claim 1, wherein the light of the light-emitting dividing part can be modulated corresponding to every pixel row taken along a scanning line of the liquid crystal panel.

5. A liquid crystal display device comprising:

a back light system including a plurality of light-emitting dividing parts which oppose a display area of a liquid crystal panel and are placed behind a light transmission type liquid crystal panel, and on which area division of a light emitting surface which illuminates with light towards the liquid crystal panel is performed, a luminescent brightness in the light-emitting dividing part being controlled according to corresponding display image of the display area in the liquid crystal panel;

a synchronous circuit for generating a driving signal synchronizing with a scanning line of the liquid crystal panel and the light-emitting dividing part in the corresponding back light system; and a lighting control part whose light is modulated so that a light-emitting of luminescence which achieves luminance of a pixel which act as maximum luminance among pixel rows taken along the scanning line is performed from the light-emitting dividing part, wherein a plurality of light-emitting dividing parts on which the area division of the light emitting surface is performed include a common organic electroluminescence layer, and one of an anode electrode or a cathode electrode is divided so as to correspond to the pixel row taken along a scanning line.

6. The liquid crystal display device according to claim 5, wherein the light-emitting dividing part is formed so as to correspond to every pixel row taken along a scanning line of the liquid crystal panel.

7. The liquid crystal display device according to claim 5, wherein the light-emitting dividing part is composed of an organic electroluminescence light emitting device.

8. The liquid crystal display device according to claim 5, wherein the light of the light-emitting dividing part can be modulated corresponding to every pixel row taken along a scanning line of the liquid crystal panel.

9. The liquid crystal display device according to claim 5, wherein the light-emitting dividing part is formed so as to correspond to every pixel row taken along the scanning line of the liquid crystal panel, and is composed of an organic electroluminescence light emitting device.

10. The liquid crystal display device according to claim 5, wherein the light-emitting dividing part is formed so as to correspond to every pixel row taken along the scanning line of the liquid crystal panel, is composed of an organic electroluminescence light emitting device, and the light of the light-emitting dividing part can be modulated corresponding to for every pixel row taken along the scanning line of the liquid crystal panel.

11. The liquid crystal display device according to claim 5, wherein:

the light-emitting dividing part is formed so as to correspond to every pixel row taken along the scanning line of the liquid crystal panel, is composed of an organic electroluminescence light emitting device, and the light of the light-emitting dividing part can be modulated corresponding to every pixel row taken along the scanning line of the liquid crystal panel; and a plurality of light-emitting dividing parts to which the area division of the light emitting surface is performed include a common organic electroluminescence layer, and one of an anode electrode or a cathode electrode is divided so as to correspond to the pixel row taken along a scanning line.

* * * * *